US006378193B1

(12) United States Patent
du Chaffaut et al.

(10) Patent No.: US 6,378,193 B1
(45) Date of Patent: Apr. 30, 2002

(54) PROCESS FOR MANUFACTURING A FLEXIBLE CONTINUOUS TUBE

(75) Inventors: Benoît Amaudric du Chaffaut, Voisin le Bretonneux; José Mallen Herrero, Paris; Patrice Jung, La Mailleraye sur Seine; Pierre Odru, Fontenay sous Bois, all of (FR)

(73) Assignees: Institut Francais du Petrole, Rueil-Malmaison cedex; Coflexip, Paris, both of (FR)

( * ) Notice: Subject to any disclaimer, the term of this patent is extended or adjusted under 35 U.S.C. 154(b) by 0 days.

(21) Appl. No.: 09/555,965

(22) PCT Filed: Dec. 11, 1998

(86) PCT No.: PCT/FR98/02702

§ 371 Date: Jun. 7, 2000

§ 102(e) Date: Jun. 7, 2000

(87) PCT Pub. No.: WO99/30850

PCT Pub. Date: Jun. 24, 1999

(30) Foreign Application Priority Data

Dec. 17, 1997 (FR) ..... 97 16036

(51) Int. Cl.[7] ..... B23P 11/00

(52) U.S. Cl. ..... 29/505; 29/509; 72/50; 138/122; 138/135

(58) Field of Search ..... 29/505, 509, 521; 72/49, 50; 138/122, 123, 129, 134, 135

(56) References Cited

U.S. PATENT DOCUMENTS

| | | | | |
|---|---|---|---|---|
| 3,707,170 A | * | 12/1972 | Mazuir et al. | 138/134 |
| 4,058,997 A | * | 11/1977 | Siegwart | 72/50 |
| 4,197,728 A | * | 4/1980 | McGowen | 138/135 |
| 6,065,051 A | * | 5/2000 | Feret et al. | 138/134 |

FOREIGN PATENT DOCUMENTS

| | | | | |
|---|---|---|---|---|
| FR | 2654795 | | 5/1991 | |
| JP | 01283494 B1 | * | 11/1989 | 138/129 |

* cited by examiner

*Primary Examiner*—David P. Bryant
*Assistant Examiner*—Jermie E. Cozart
(74) *Attorney, Agent, or Firm*—Antonelli, Terry, Stout & Kraus, LLP

(57) ABSTRACT

The invention concerns a method for the continuous production of a flexible tube body from two stapled wires (9, 10) individually bent in bending means (7, 8), three stitches, unsupported by a mandrel, and such that wires (9, 10) remain constantly in contact so as to optimize their resistance to external pressure. Bending means (7, 8) can be arranged with respect to each other without affecting the bending adjustment. The method consists in stapling the two spirals by elastically deforming the turns so that one crosses the other to cause the wires to overlap partially. The invention also concerns an equipment for producing a flexible tube body.

6 Claims, 9 Drawing Sheets

PROCESS FOR MANUFACTURING A FLEXIBLE CONTINUOUS TUBE

FIELD OF THE INVENTION

The present invention relates to a method and to a device for making a cylindrical metal structure referred to as body and consisting of several wires stapled to one another. This type of body is notably usable in the multilayer structures of reinforced flexible pipes for withstanding the stresses due to internal or external pressures or to longitudinal loads. One may refer to document API RP 17B (First edition, Jun. 1, 1988) which describes and defines flexible structures.

BACKGROUND OF THE INVENTION

There are well-known <<rough bore >> type pipes internally comprising a double-stapled metal section forming an internal body directly in contact with the fluid under pressure. The main purpose of this body is to withstand collapse under the effect of the external pressure transmitted by the extruded plastic sheath on this body. Other layers of internal pressure-resistant reinforcements, tension-resistant reinforcements, sealing plastic sheaths are arranged over this sheath. Document FR-2,654,795 describes a body made by plastic deformation of a flat metal strip such as a stainless steel strip in order to give it the shape of a double-stapled metal section. The body is formed by spiral winding of the strip, i.e. by small-pitch helical winding with interlocking, followed by a last deformation to provide stapling locking. It can be noted that, considering the manufacturing mode, the thickness of the strip cannot provide the final product with a very great transverse inertia, which limits the collapse strength of bodies according to the prior art.

The present invention allows to make a body with a greater collapse strength by using wires having a section of greater inertia. Wires of specific cross-section are therefore used to provide lateral stapling of the wires, i.e. limitation of the clearance between the turns in the direction of the longitudinal axis of the flexible pipe. In the present invention, the wires are not self-stapling wires, i.e. having a section with one and the same shape and arrangement, generally S or Z-shaped, which allows each turn to be fastened to the previous one by means of its complementary profiles.

Document FR-2,650,652, mentioned here by way of reference, describes wires having a T or U-shaped section. The U-shaped staplable (not self-stapling) wires can be described as having a substantially rectangular section comprising, at both ends of one side of the rectangle, generally the greatest length, convex ribs or bosses, thus forming the vertical stems of the U. When at least one of the turns is formed by a U-shaped wire, the helical winding is longitudinally locked by another U-shaped wire whose bosses are turned towards the bosses of the first wire and placed in the recesses of the U. There is thus no radial locking but only a longitudinal locking in relation to the axis of the pipe, with an allowable clearance according to the width and the space between the bosses. The absence of radial locking imposes relative precise control of the radial clearance between the inner wire and the outer wire because it is important, for the resistance to external pressure, that the wires are in contact or practically in contact with one another. The T-shaped staplable (not self-stapling) wires can be described as a U-shaped wire comprising, in the central part between the lateral bosses, a convex reinforcement (stem of the T) substantially perpendicular to the base (stroke of the T), the stem of the T of one of the wires being intercalated between the turns of the other wire.

The main difficulty for forming a body with staplable, and not self-stapling, wires (see above) having a great transverse inertia lies in the fact that the sections of the inner wire and of the outer wire do not have their axes of inertia, or their neutral fibers, equidistant from the axis of the pipe. In fact, the inner wire and the outer wire are arranged head to foot in relation to the stapling means, which leads to the fact that the axis of inertia of the outer wire is on a circle of greater radius than that of the axis of inertia of the inner wire, unlike self-stapling S or Z-shaped wires whose wire inertias coincide since the sections of the wires are identical and arranged similarly and at the same distance from the axis of the pipe. Thus, if preforming of the two inner and outer wires is performed identically with the same radius of curvature (on a supporting mandrel for example), relaxation of the deformation stresses, or elastic relaxation, can lead the outer wire to separate from the inner wire. This might lead to a decrease in the resistance to external pressure since the two inner and outer wires do not resist jointly. Furthermore, the body might come easily unhooked during later handling.

SUMMARY OF THE INVENTION

The present invention thus relates to a process for manufacturing a flexible continuous tube from two spiral wires whose T or U-shaped cross-sections comprise lateral bosses at the base of the U or the stem of the T, the two wires being arranged in relation to each other so that the bosses of one wire face the bosses of the other wire, stapling being performed by partial overlapping of one wire over the other. The process comprises the following stages:

- injecting each wire into independent bending means consisting of at least three rollers arranged in relation to one another so that the wire, after bending, has the shape of a spiral of determined diameter and pitch,
- adjusting the rate of injection of each wire according to the real length of each wire for the same number of turns,
- arranging each bending means in relation to one another so that the turns of the wires are coaxial and that the wires, once bent, cross each other in order to be stapled by means of an elastic deformation in the radial and longitudinal direction.

In the process, the stapled position of the two wires can be secured by holding them one upon the other by means of two rollers.

The ratio of the areas of the sections of the inner and outer wires can range between 0.5 and 1.5.

The two wires can have identical T or U-shaped sections. One wire can be T-shaped, the other U-shaped.

The invention also relates to an equipment for producing a flexible tube from two spiral wires whose T or U-shaped cross-sections comprise lateral bosses at the base of the U or the stem of the T, the two wires being arranged in relation to one another so that the bosses of one wire face the bosses of the other wire, stapling being performed by partial overlapping of one wire over the other. The equipment comprises bending means consisting of at least three rollers for each wire, bending means each connected to an independent frame and that can be positioned in relation to one another while maintaining the adjustment of the bending rollers, means for injecting the wire into said bending means and means for adjusting the injection rate.

The process is applied for producing a flexible tube body that must withstand an external pressure and comprising no inner tube.

BRIEF DESCRIPTION OF THE DRAWINGS

Other features and advantages of the present invention will be clear from reading the description hereafter of a non limitative example of a manufacturing process and of the means for implementing the process, with reference to the accompanying drawings wherein.

DETAILED DESCRIPTION

The principle of the process according to the invention consists of three main operations:

independently bending each (inner and outer) wire so that, after bending, the wires have the final pitch and diameter of the spiral, while remaining in radial contact, assembling the inner wire and the outer wire by progressively causing the turns to fit into each other, by using the coaxiality and the elasticity of these turns without going into the plastic domain, adjusting very precisely the rates of injection of the inner and outer wires into the bending means.

Figure 1A:
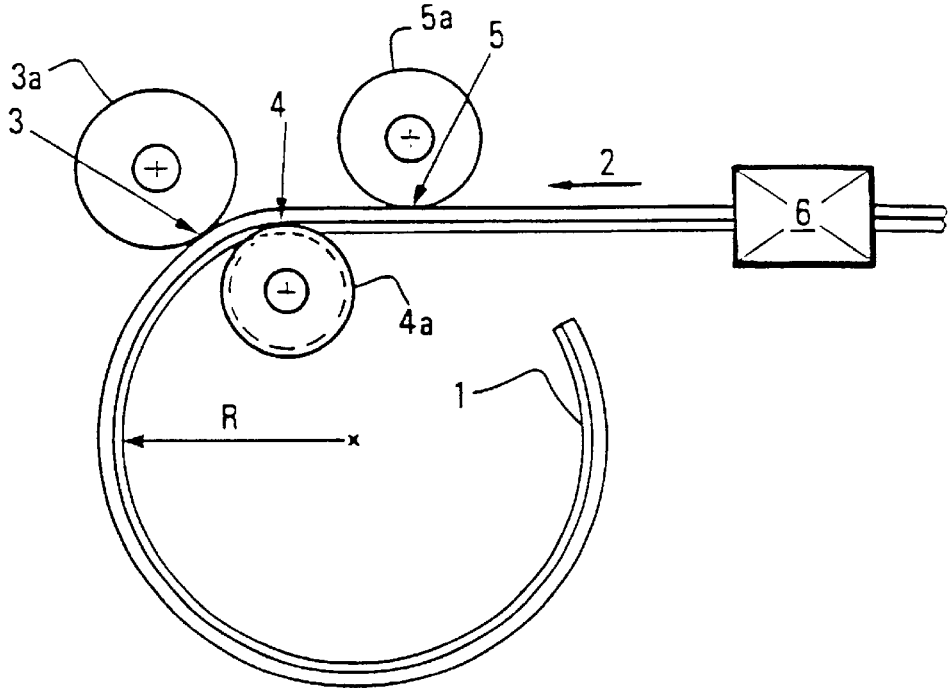
FIGS. 1A and 1B diagrammatically show the three-stitch bending principle.

In FIG. 1A, wire 1 is pushed in the direction shown by arrow 2 by wire feed means 6, shown here symbolically and which can be, for example, motor-driven rollers, crawlers or equivalent means. Wire 1 is plastically deformed by the three supports 3, 4 and 5 of rollers 3*a*, 4*a* and 5*a*. Supports 3, 4 and 5 can consist of other well-known means used in the trade, for example fork type rods when the material of the wire to be preformed is more malleable. The respective position of the three supports gives a determined plastic deformation to said wire, so that after relaxation, after deformation, the turn of wire 1 has a radius R corresponding to the radius of the final product, i.e. a body made of stapled wires.

Figure 1B:
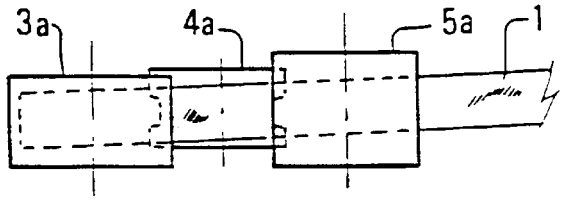

Figure 1B is a top view of the binding means illustrating the offset position of rollers 3*a* and 4*a* in relation to first roller 5*a* in order to laterally deform the wire so as to form a helix.

The deformation principle is the same for an inner or an outer wire, except that the lengths of the two wires are slightly different per turn, notably because the diameter of the neutral fiber of the inner wire is different from the diameter of the neutral fiber of the outer wire. It has therefore been observed that, in order to obtain a body with the required mechanical characteristics, it is essential in the present invention to suitably adjust the feed rates of the two wires. The required lengths per turn can therefore be calculated or measured by winding a large number of turns (between 15 and 20) of the two inner and outer wires according to the determined geometry by using either the preforming mode mentioned above, or possibly on a testing mandrel whose outside diameter corresponds exactly to the inside diameter of the body to be produced. A lathe can be used for winding, then the consumed lengths are measured. This method is much more accurate than theoretical calculation. It can be noted that it is therefore absolutely necessary for the wire feed means 6 to have independent feed rate adjustment means.

Figure 4A:
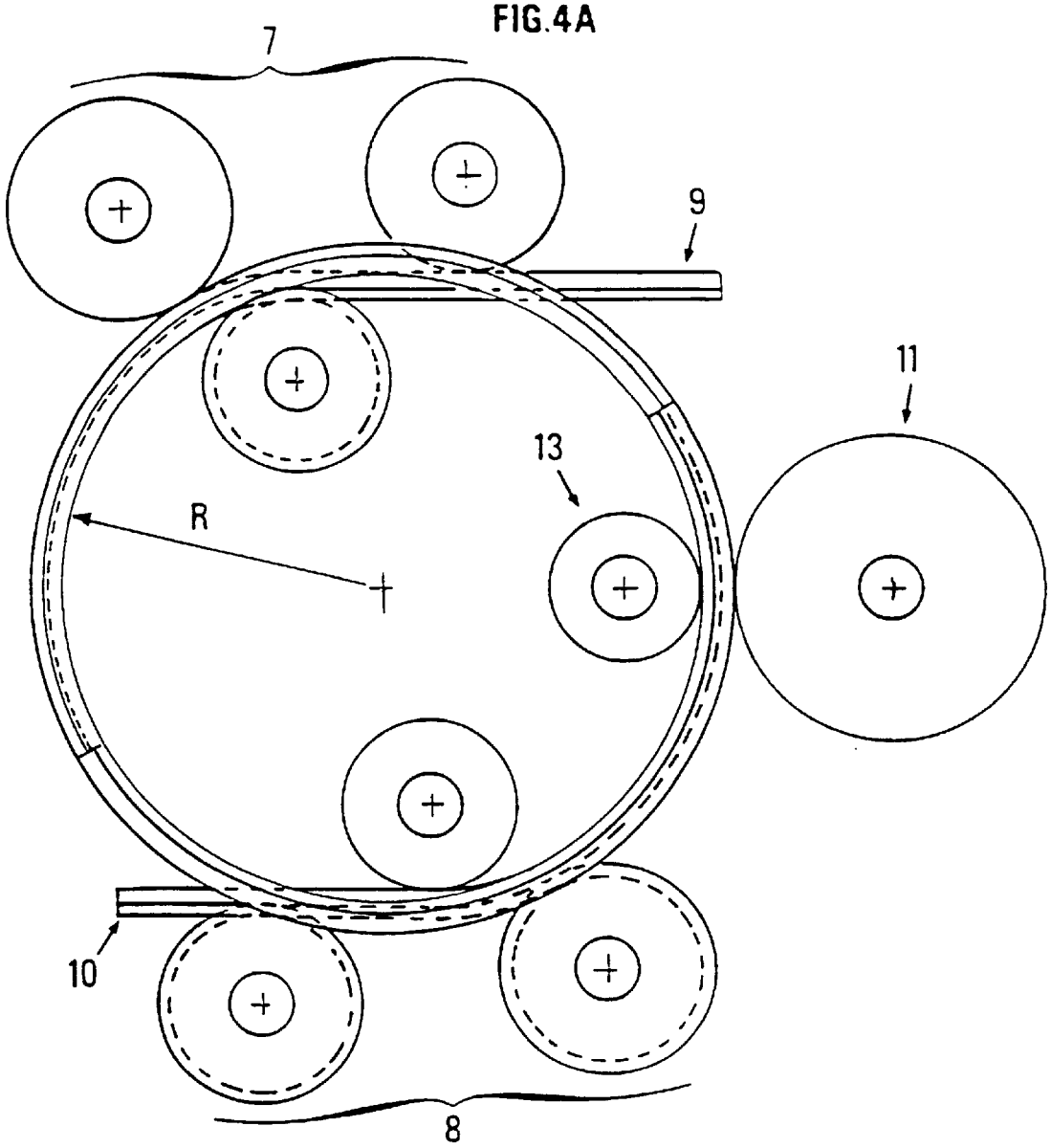

Once the required diameters and pitches are obtained for each wire, the next operation consists in making the turns coaxial. FIG. 4*a* shows the position at about 180° between forming means 7 for outer wire 9 and forming means 8 for inner wire 10. The two forming means are placed on independent plates or tables allowing displacement along three axes (horizontal and vertical and inclination in relation to the axis of the pipe) of said means without changing the relative positions of the bending rollers. It is in fact clear that suitable mechanical means are necessary to precisely orient the plane of a wire turn in relation to the plane of the other wire in order to make a body made of wires that must fit into each other in order to become stapled as they are preformed. Feed means 6 (FIG. 1A) are also mounted adjustable so that the pushed wire is fed into the bending means with the optimum determined angle and the radial position so as to bring the two wires tangentially to the desired diameter.

Roller 11 (FIG. 4A) is a complementary means for stapling wires 9 and 10. A supporting counter-roller 13 is preferably added.

Figure 2:
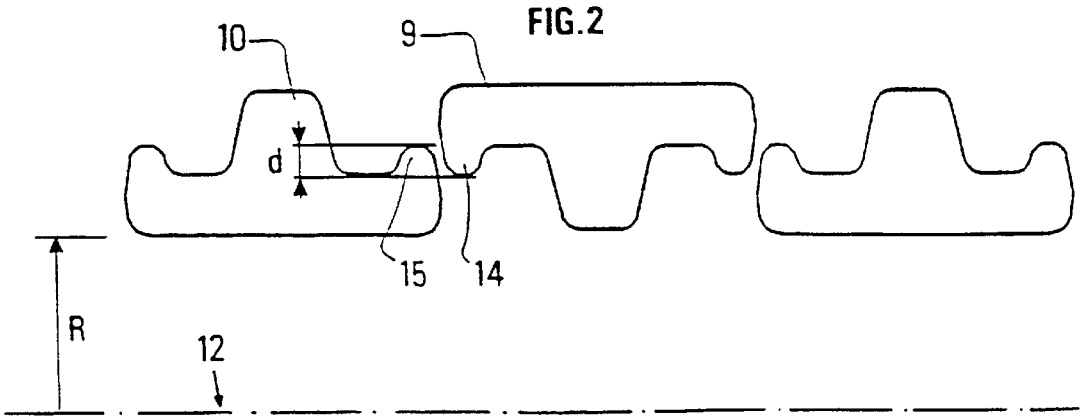
FIG. 2 is a radial sectional view of an example of non-stapled bent wires.

FIG. 2 is a sectional view of the turns once formed at the required radius R. In relation to axis 12 of the body, wire 10 is the inner wire whose distance from the back to axis 12 is R, wire 9 is the outer wire where the flat part of the stem of the T is at a distance R from axis 12. In order to obtain stapling and to make the body with the inner and outer wires properly positioned in the radial and axial directions, it is possible to either reduce the diameter of the turn of inner wire 10, or to increase the diameter of the turn of outer wire 9, or to perform both deformations simultaneously, so that boss 14 of outer wire 9 is placed above boss 15 of inner wire 10. In any case, according to the present invention, deformations for stapling, performed after bending plastic deformations, remain within the elastic domain of the wires material in order to have the nominal bending diameters after the stapling operation. The inner and outer wires thus form interlocked spirals with a generally minimum controlled clearance in the radial direction in order to obtain sufficient contact between the two wires, which provides good resistance to external pressure.

It can also be seen in FIG. 2 that the wire (the outer wire here) preformed by bending means 8 situated downstream from first bending means 7 is entirely contained between a turn of the other wire over a distance of about a quarter turn. The spiral of the first wire (inner wire 10 here) is thus elastically deformed in the direction of the longitudinal axis of the pipe before stapling.

The relative positions of the bending means control both the elastic deformation of at least one turn in the radial direction and the elastic deformation of the pitch of the turn of a wire, the other wire passing through the space corresponding to the elastically stretched nominal pitch.

Figure 3A:
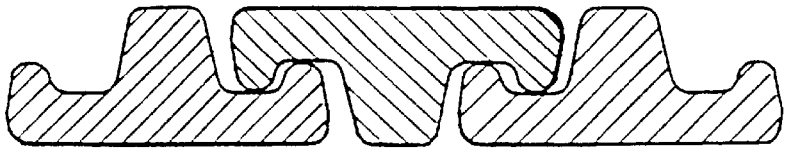
FIGS. 3A, 3B, 3C and 3D are radial sectional views of examples of bodies obtained according to the invention, FIGS. 4A and 4B diagrammatically show the bending and stapling means.
Figure 3B:
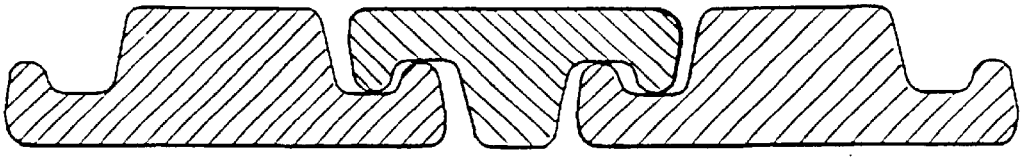
Figure 3C:
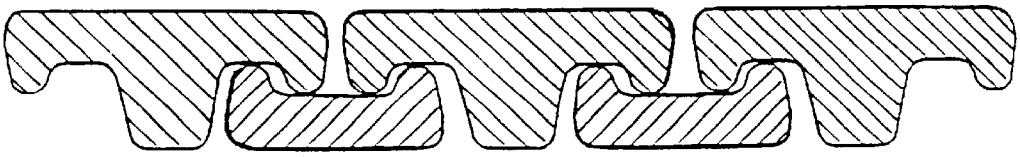
Figure 3D:
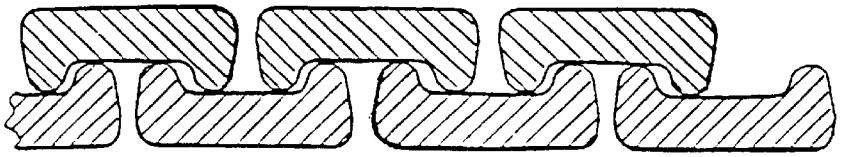

FIGS. 3A, 3B, 3C and 3D illustrate the various wire sections that can be combined according to the present invention to produce a body without an inner mandrel type support. FIG. 3A shows the section of two identical inner and outer wires. FIG. 3B shows the section of two T-shaped wires, one having a larger section than the second wire. FIG. 3C shows the section of a T-shaped wire stapled by a U-shaped wire. FIG. 3D shows the section of two U-shaped wires of similar section, but which can have different sections without departing from the scope of the present invention. Of course, the various wires can be inner or outer wires.

Figure 4B:
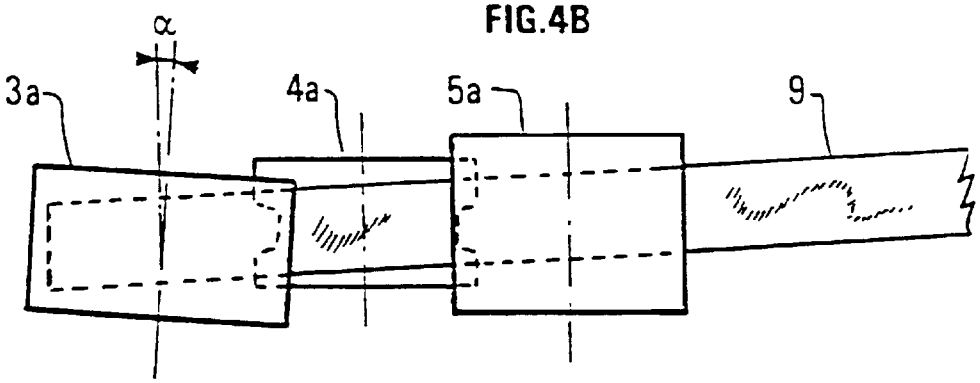

FIG. 4B is a top view of the bending wheels, the last one, 3*a*, being offset by an angle $\alpha$ in relation to the axis of the body so as to force bending along an axis that is not perpendicular to the axis of the wire. The <<overlapping>> effect known in the field of tube or cable reinforcement with flat wires is thus limited.

The process according to the invention will be clear from reading the description hereafter of the accompanying photographs.

Figure 5:
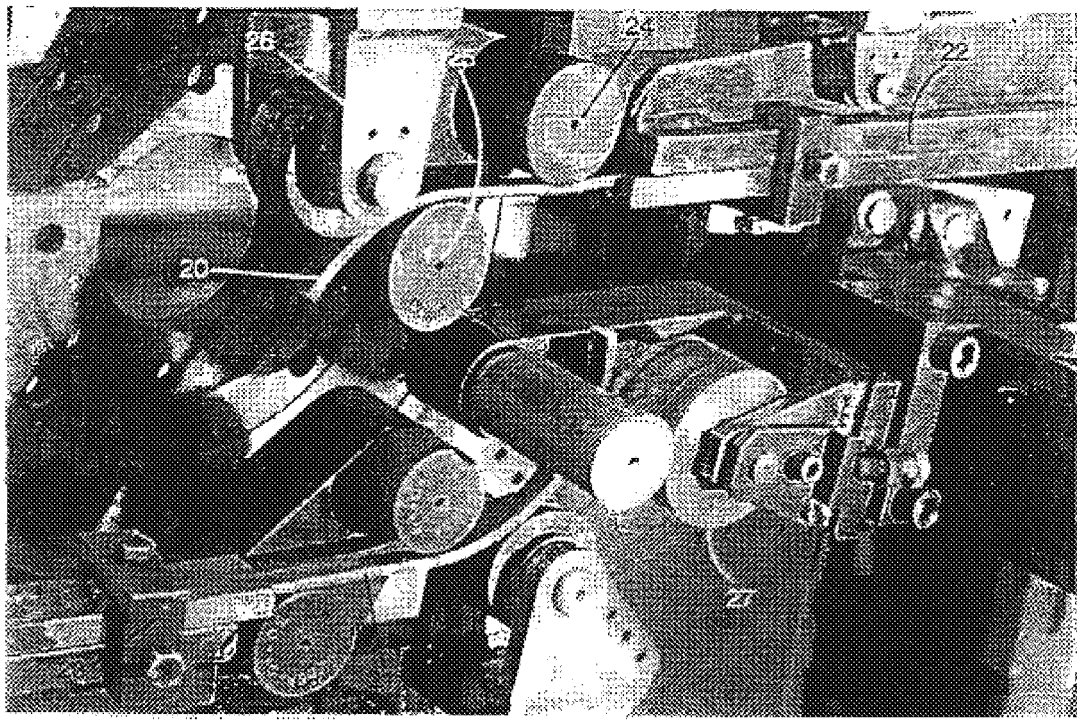
FIGS. 5 to 16 illustrate the operating method of the process.

FIG. 5: The two T-shaped wires (inner wire 21 and outer wire 20) are introduced through slide systems 22 and 23 which are an extension of the push means that are not shown here. The means for bending the outer wire consist of rollers 24, 25 and 26. The same set of rollers is arranged symmetrically in relation to the centre for inner wire 21. It can be noted that roller 27 is arranged so as not to interfere with inner wire 21, just after bending.

Figure 6:
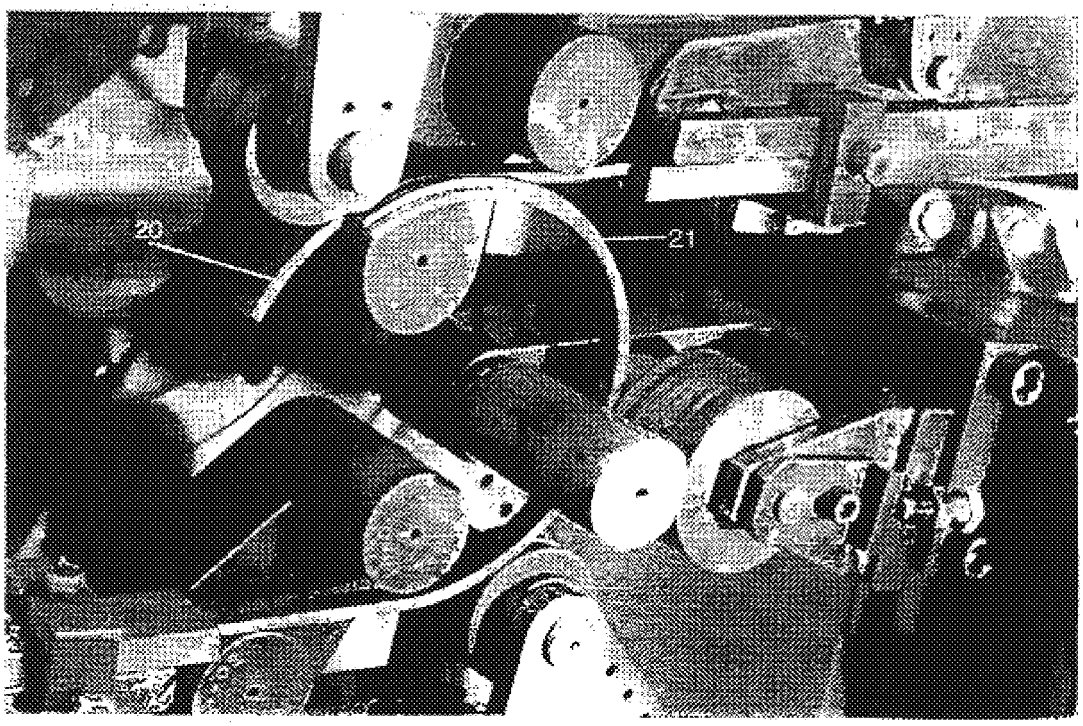

FIG. 6: Unwinding of outer wire 20 is stopped while inner wire 21 is brought to the same level as and next to wire 20. There is no stapling of the wires.

Figure 7:
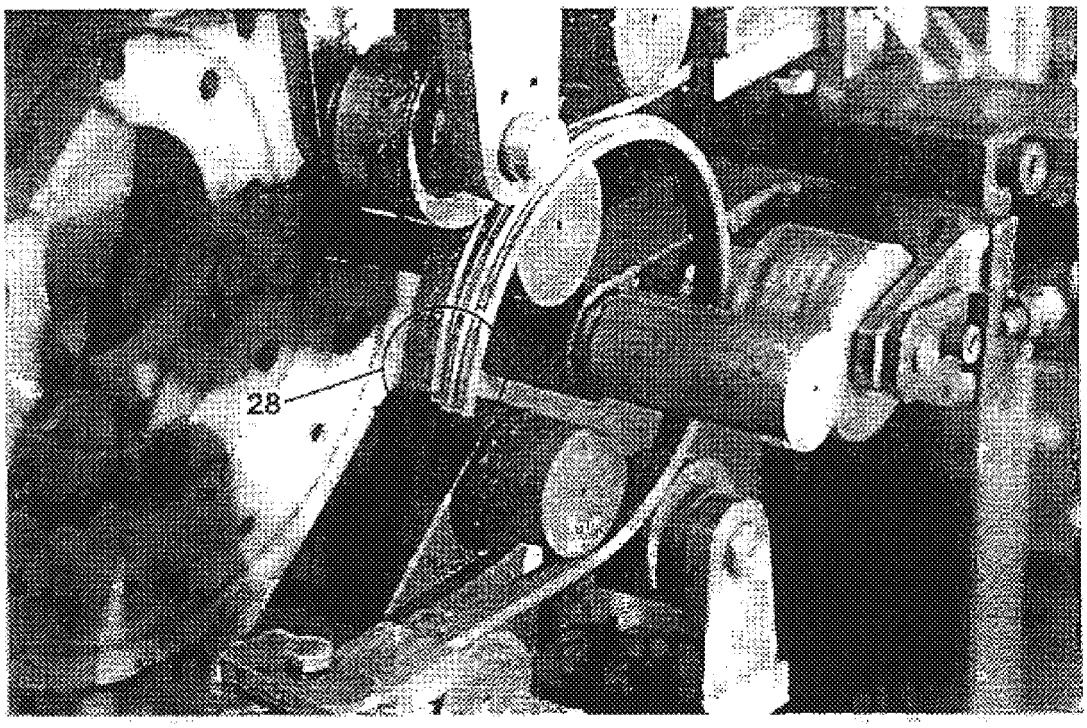

FIG. 7: The wires are now continuously injected at the predetermined rates. Stapling starts in zone 28. It can be noted that positioning of the axis of injection of the wires is precisely adjusted so that the turns slightly cross each other in order to start stapling. The elasticity of the turn of the inner wire is used therefore.

Figure 8:
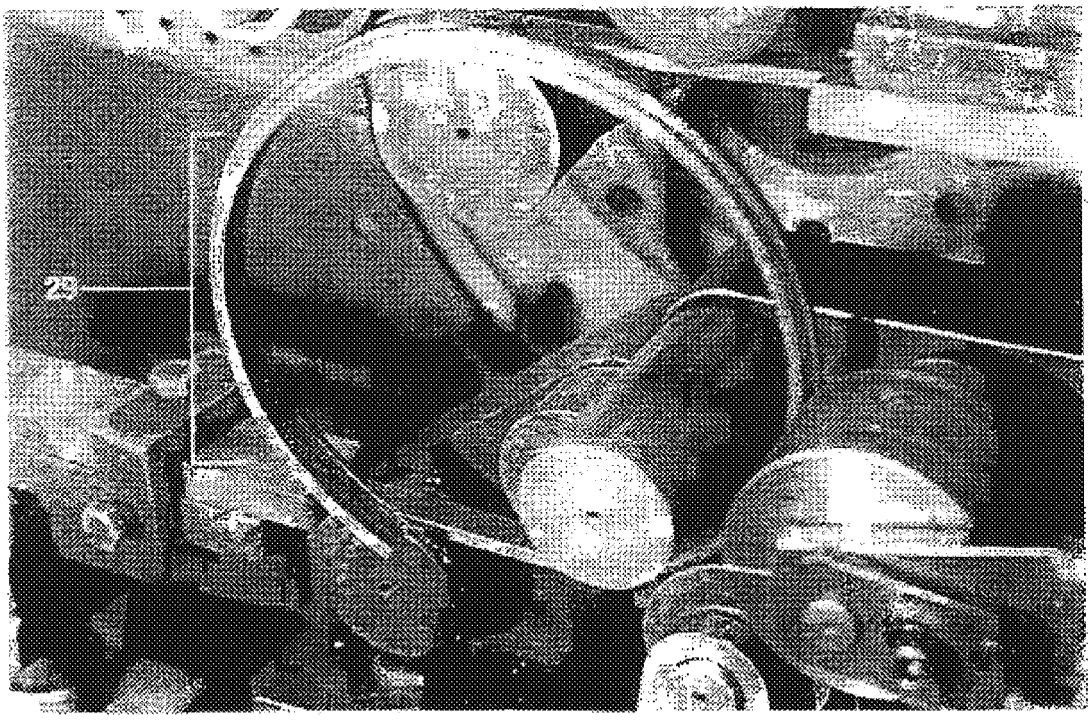

FIG. 8: Along zone 29, the two wires have the nominal diameter and they are stapled.

Figure 9:
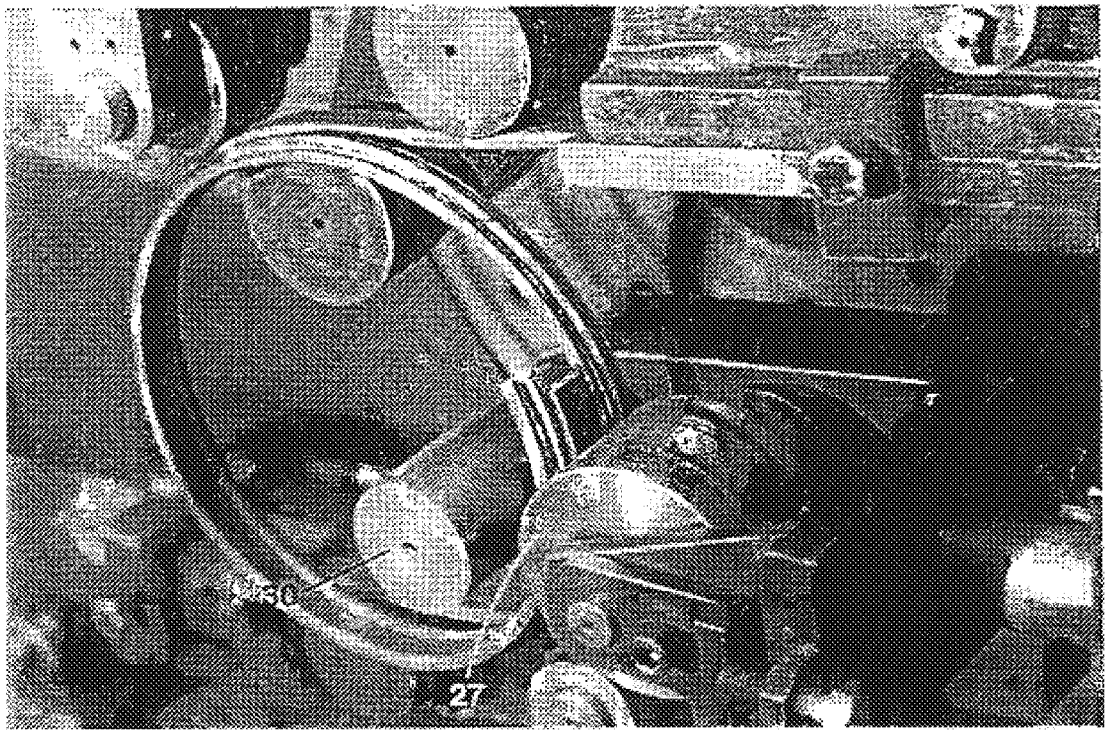

FIG. 9: The two wires enter the space between stapling roller 27 and support 30. Outer wire 20 is stapled on one side only, the other side being situated laterally to the neighbouring turn.

Figure 10:
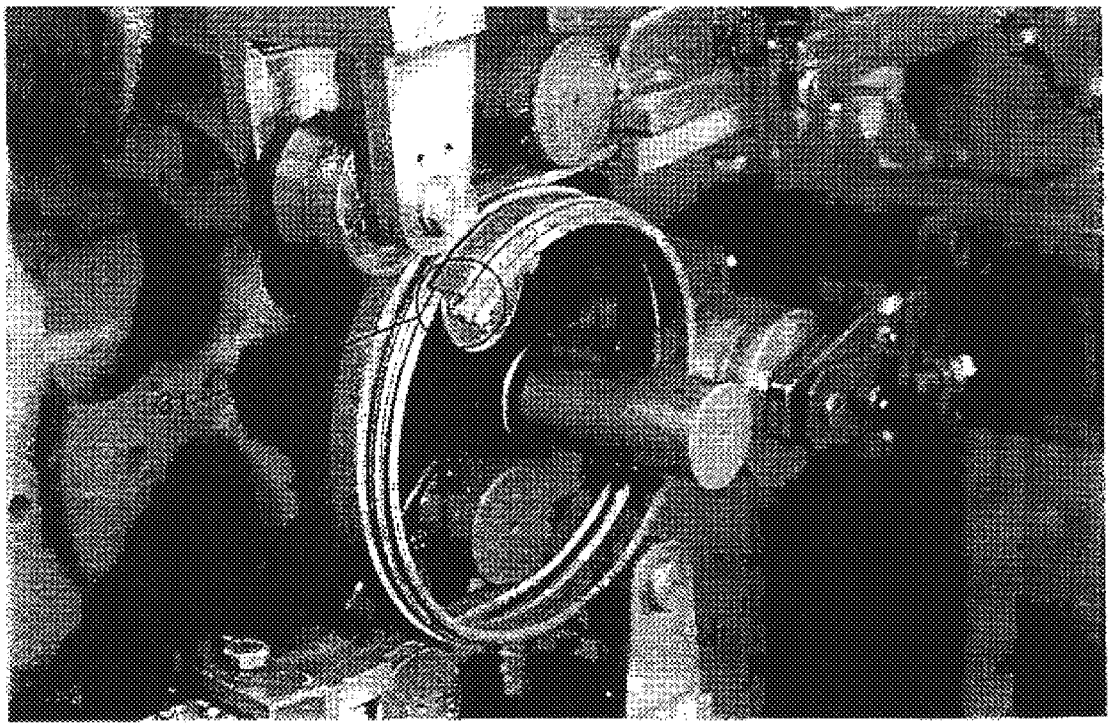

FIG. 10: From that angle, the outer wire starts being stapled with the inner wire in zone 31. It can be noted that the stapling mode is similar to the mode used in zone 28 of FIG. 7.

Figure 11:
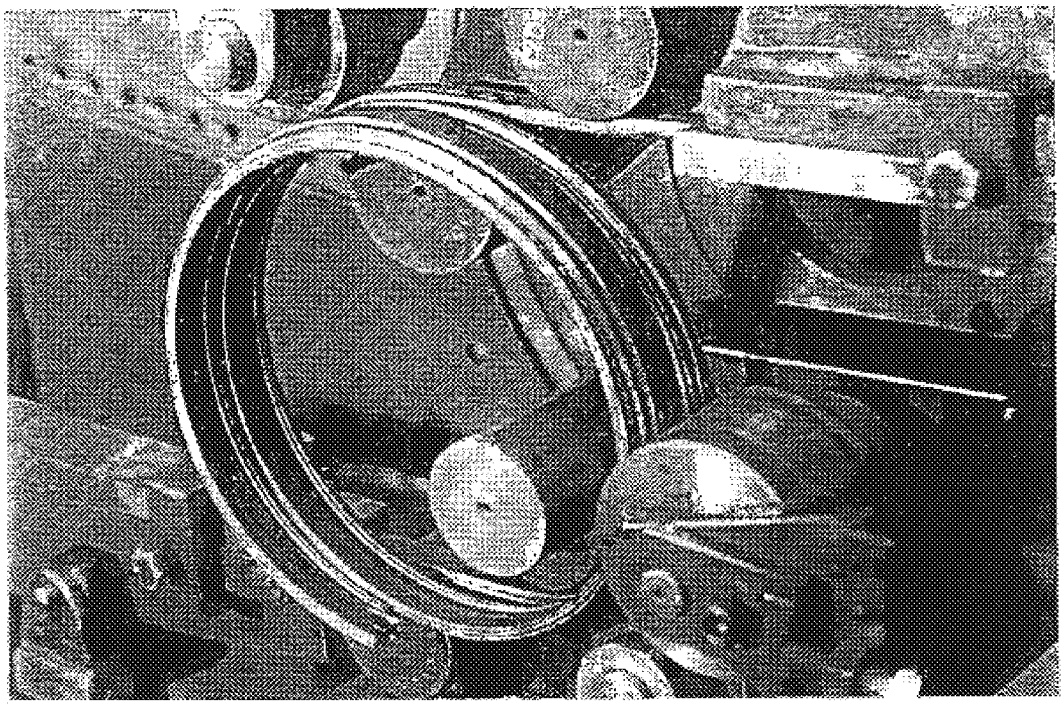
Figure 12:
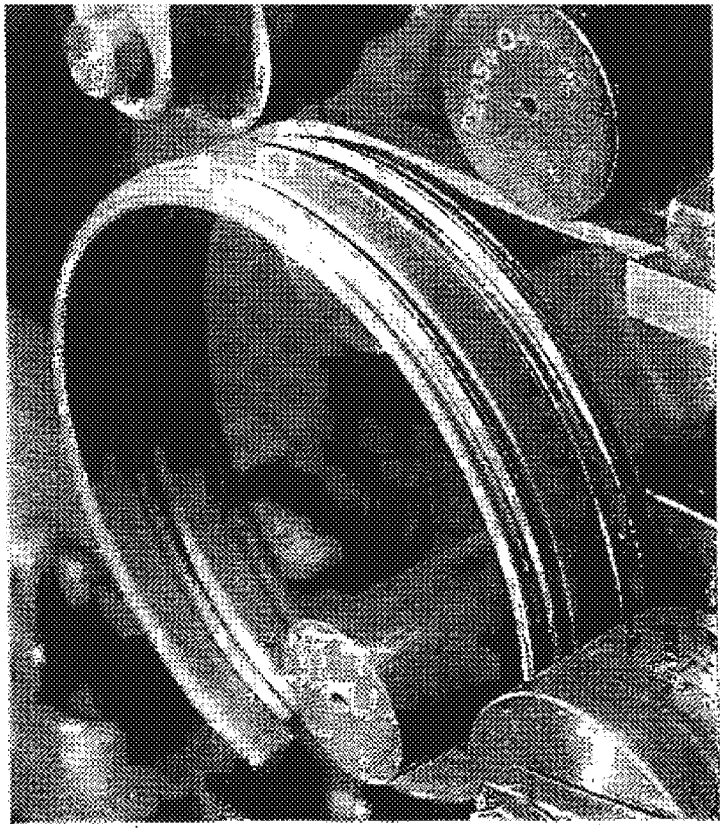
Figure 13:
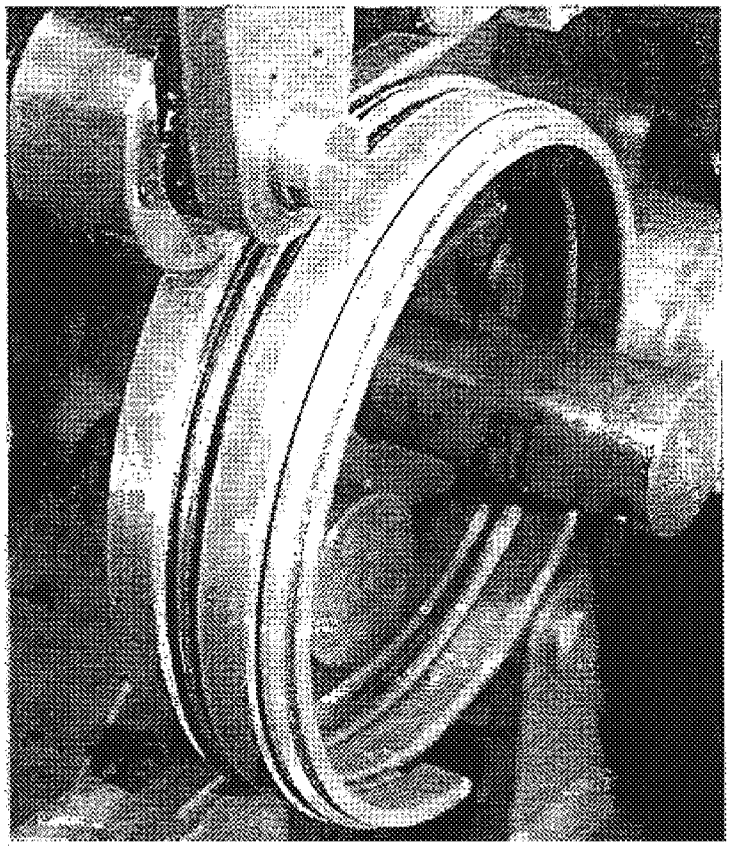

FIGS. 11, 12 and 13: Stapling continues naturally, the outer wire being now stapled on both sides.

Figure 14:
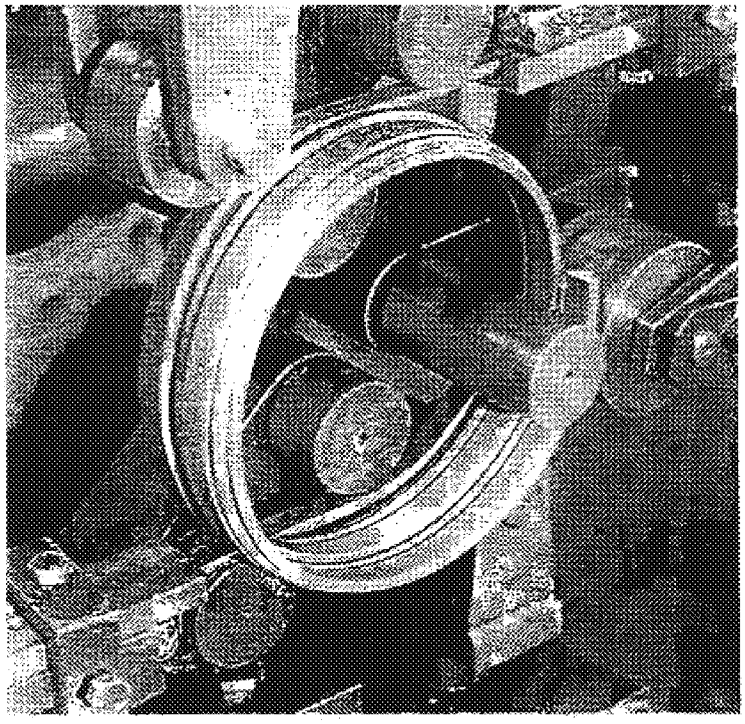
Figure 15:
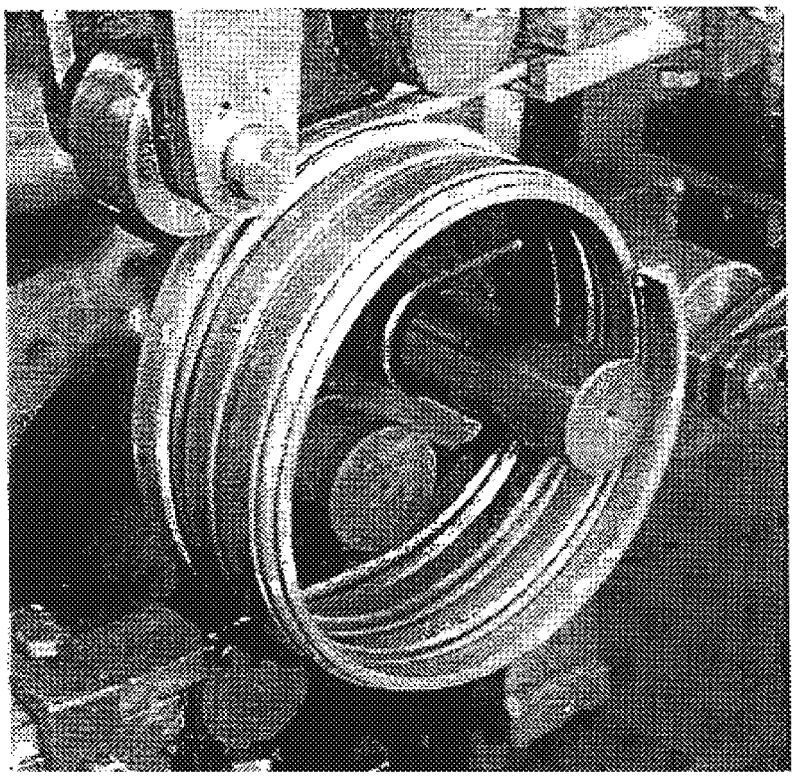
Figure 16:
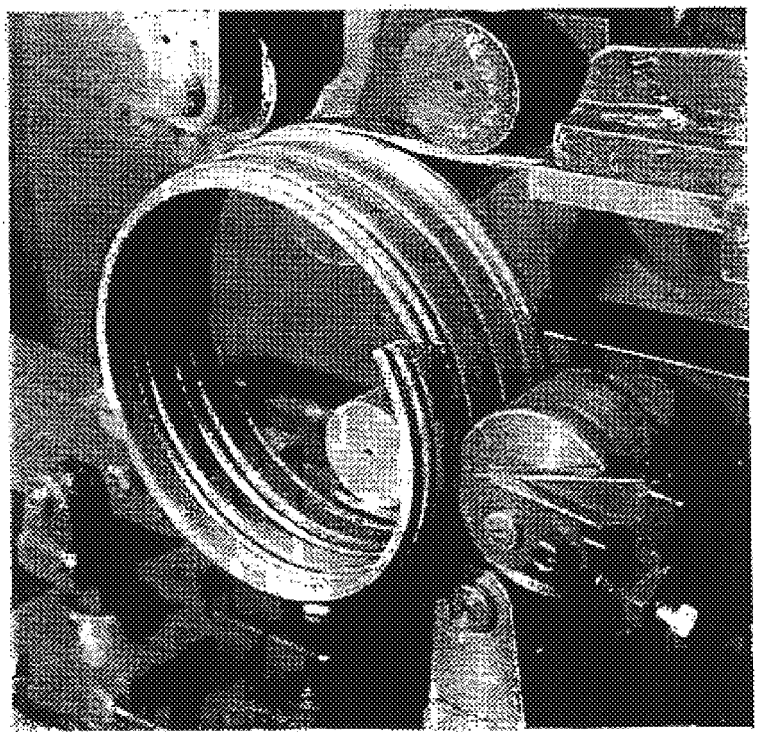

FIGS. 14, 15 and 16: The two turns consisting each of two stapled wires are now stapled to each other, they are clamped and held in the stapling rollers.

The manufacturing machine is here fixed to the ground so that the body produced revolves around its axis as the two wires are injected and preformed. The invention is not limited to this type of experimental machine, but it can be directly applied to wire drawing machines that entirely revolve around the axis of the body. The wire reels and the bending means are placed on a rotating assembly whose rotating speed corresponds to the rotating speed of the body made with the machine shown here.

What is claimed is:

1. A process for manufacturing a flexible continuous tube from two spiral wires whose T-shaped or U-shaped cross-sections comprise lateral bosses at a base of the U or a stroke of the T, the two wires being arranged in relation to one another so that the bosses of one wire face the bosses of the other wire, stapling being performed by partial overlapping of one wire over another wire, comprising:

injecting each wire into independent bending means comprising of at least three rollers arranged in relation to one another so that the wire, after bending, has the shape of a spiral of determined diameter and pitch, adjusting the rate of injection of each wire according to the real length of each wire for the same number of turns, arranging each bending means in relation to one another so that the turns of the wires are coaxial and that the wires, once bent, cross each other to perform stapling by means of an elastic deformation in the radial and longitudinal direction.

2. A process as claimed in claim 1, wherein the stapled position of the two wires is secured by holding one wire against the other by means of two rollers.

3. A process as claimed in claim 1, wherein the ratio of the areas of the wire sections ranges between 0.5 and 1.5.

4. A process as claimed in claim 1, wherein the two wires have similar T-shaped or U-shaped sections.

5. A process as claimed in claim 1, wherein the one wire is T-shaped, the another wire is U-shaped.

6. A process as claimed in claim 1, wherein the flexible continuous tube is a flexible tube body designed to withstand an external pressure.

* * * * *